US006138971A

United States Patent [19]

Cesari et al.

[11] Patent Number: 6,138,971

[45] Date of Patent: Oct. 31, 2000

[54] SPACE SAVER CLOSEABLE WALL MOUNTABLE IRONING BOARD

[76] Inventors: Giulio Cesari; Alessandra Cesari, both of Via Sisto V 31, 04100 Latina, Italy

[21] Appl. No.: 09/155,846

[22] PCT Filed: Apr. 14, 1997

[86] PCT No.: PCT/IT97/00081

§ 371 Date: Oct. 7, 1998

§ 102(e) Date: Oct. 7, 1998

[87] PCT Pub. No.: WO97/39174

PCT Pub. Date: Oct. 23, 1997

[30] Foreign Application Priority Data

Apr. 15, 1996 [IT] Italy ..... LT96A0003

[51] Int. Cl.[7] ..... E04G 3/00

[52] U.S. Cl. ..... 248/292.14; 248/291.1; 248/286.1; 248/284.1; 38/103; 108/48

[58] Field of Search ..... 248/292.14, 291.1, 248/288.11, 284.1, 286.1, 240; 38/103; 108/39, 42, 48

[56] References Cited

U.S. PATENT DOCUMENTS

| | | | |
|---|---|---|---|
| 1,111,151 | 9/1914 | Heartman | 38/103 |
| 1,136,878 | 4/1915 | Hornschuck | 38/103 |
| 1,796,569 | 3/1931 | Madsen | 108/39 |
| 3,965,588 | 6/1976 | Long | 38/103 |
| 4,834,332 | 5/1989 | Vanderbilt | 248/292.14 |
| 5,329,860 | 7/1994 | Mattesky | 108/48 |

*Primary Examiner*—Ramon O. Ramirez
*Assistant Examiner*—A. Joseph Wujciak, III

[57] ABSTRACT

The object of the invention is to provide a space saver ironing board that can be easily utilized and may be placed in any room of the house. In the closing position it is hung up on the wall and occupies a very small volume, comparable to that of a medium size picture (FIGS. 3 and 4). The opening movement is very simple and manageable: the space saver ironing board is rotated down from the wall until the horizontal working position (the figure), while it hanging on the wall. The rotation hinge is inserted into a fixed support wall bracket. The ironing board can be used in this position or unhooked from the wall and moved elsewhere (FIG. 5). Through the closing movement every part finds its proper position: one of the pair of legs (3) with their triangular cross-piece (5) provides the frame for the entire structure when in the closed position. The front panels (10) fixed to the underside of the legs cover the front of the structure (FIG. 4), behind which are hidden the closed ironing board surface (6) and the other legs (4) in vertical position.

5 Claims, 4 Drawing Sheets

SPACE SAVER CLOSEABLE WALL MOUNTABLE IRONING BOARD

TECHNICAL FIELD

Our invention relates to the home furniture field and specifically to the ironing board one. The ironing board is a fixture of every house, independent of the size, characteristics and habits of the family.

BACKGROUND FIELD

The ironing board is an indispensable fixture, but today's types occupy much space and are not very esthetic to the decor of the house. They are also inconvenient, in that they typically must be moved or hidden in a closet or some other place for storage.

Present ironing board solutions are typically difficult to open/close, are exposed to dust and dirt and must be moved to clean their storage area.

The patent U.S. Pat. No. 4,834,332 solution shows the advantage of moving the ironing board from a vertically stored position to a work position by a mounting mechanism including a bracket; but, in spite of that, this innovation still requires a cabinet or a box to enclose and restore the ironing board.

DISCLOSURE OF INVENTION

The space saver ironing board invention's purpose is to eliminate these problems. It is a trasnsformable piece of furniture: in the closed position it is hung up on the wall, occupying a very small volume, and is enclosed in its own structure.

The space saver ironing board is attached to the wall at its base by inserting it into a fixed support wall bracket (1). The closed position is held by a spring locking pin (2) in the wall bracket and by a security hook (3) in the wall.

The opening/closing movement is very simple and manageable: as the ironing board is rotated down (or up) from the wall until reaching the horizontal (or vertical) position while it is hanging on the wall and its weight is supported by the wall bracket.

The structure is made of two pairs of crossing legs with different shapes and sizes, being a first pair of legs (4) exterior as regard to a second pair of legs (5) (FIG. 1 and FIG. 6)).

The first pair of legs (4) are cut with an angle of inclination of approximately 45° degrees: their lower ends are connected by a cross-piece (6) with a triangular section and their upper ends are pivotally connected at the base of the ironing board (7) by a hinge (8); the hinge (8) can be hooked on the openings of the side wings of the bracket (1).

The second pair of legs (5) are pivotally crossed to the first pair (4) in the middle of the lenght by a shaft (9): their upper ends slide along two rails (10) on the bottom of the ironing surface (7) (FIG. 2) and their lower ends are connected to a second cross-piece (11).

To open the ironing board first pull and release the spring locking pin (2) that secures the first pair of legs (4) to the wall bracket (1). Second rotate the first pair of legs (4) down to the end of their run (approximately 45° degrees). Thirdly release the security hook (3) and rotate down the entire structure to the horizontal working position; to close the ironing board follow the opening procedure in reverse order (FIG. 1 and FIG. 5).

The space saver ironing board can be used in this position or unhooked from the wall bracket and moved elsewhere.

The underside of the ironing surface (7) and the second pair of legs (5) may be covered in the closed position by either a single removeable front panel or by two front panels (12) fixed to the underside of the two pairs of legs (4 and 5) (FIG. 4 and FIG. 6).

These front panels may be made of different types of material: wood, paper, fabric, mirror, writeable plastic surface, magnetic board, picture frame, etc.

The various components of the ironing board may be made of different types of material such as wood, plastic, metal, etc. Furthermore the space saver ironing board structure is available to mount working surfaces made of different types of shape and material.

Once closed the space saver ironing board is a small compact structure (FIG. 3 and FIG. 4) that is trimmed by the first pair of legs (4) and by two cross-pieces (6 and 11), the second pair of legs (5) and the ironing board (7) closing vertically behind the front panels (12).

The space saver ironing board with its esthetics may be placed in any room of the house.

DRAWINGS REFERENCE NUMERALS

Figure 1:
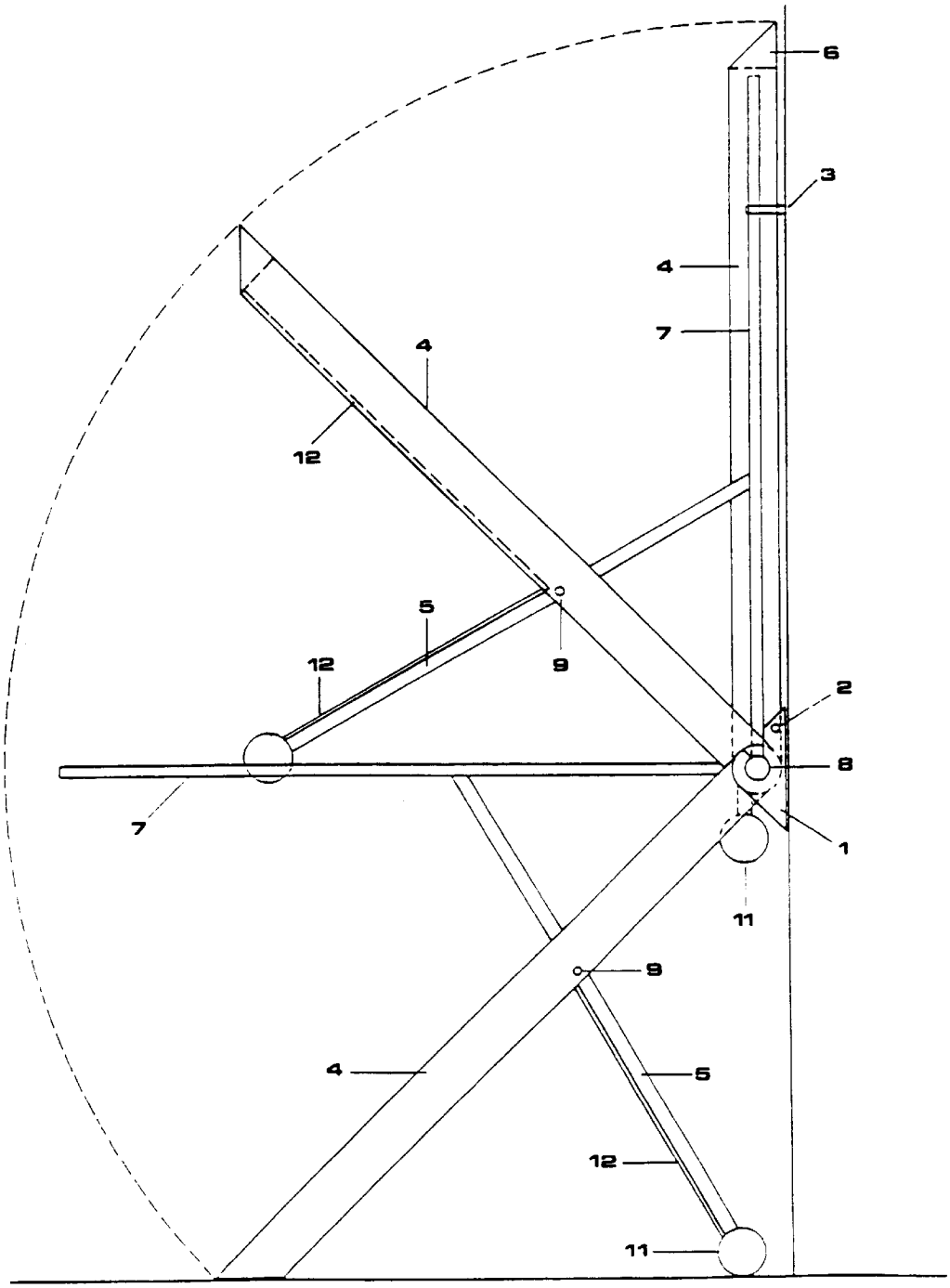
FIG. 1 illustrates the movement of rotation from the closed to open position.
Figure 2:
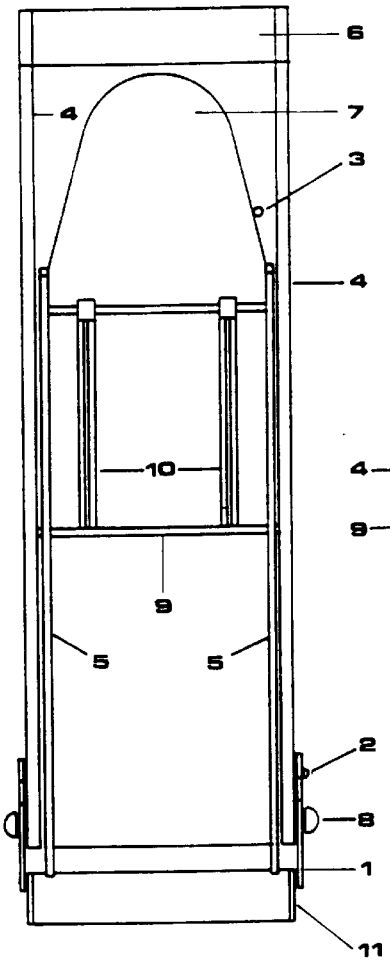
FIG. 2 and FIG. 4 illustrate the frontal views of the ironing board in its closed position, respectively without front panels and with front panels.
Figure 3:
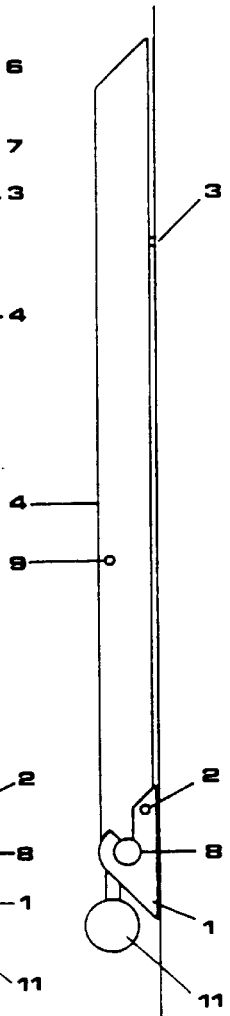
FIG. 3 illustrate the side view of the ironing board in its closed position.
Figure 4:
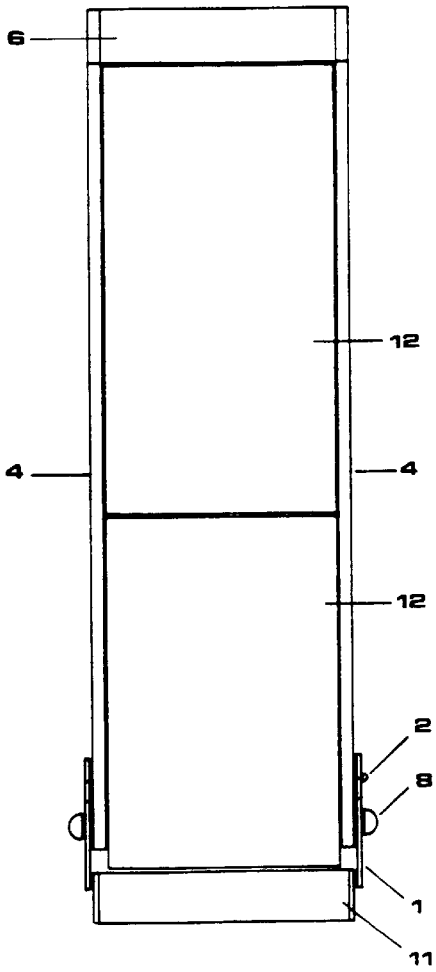
Figure 5:
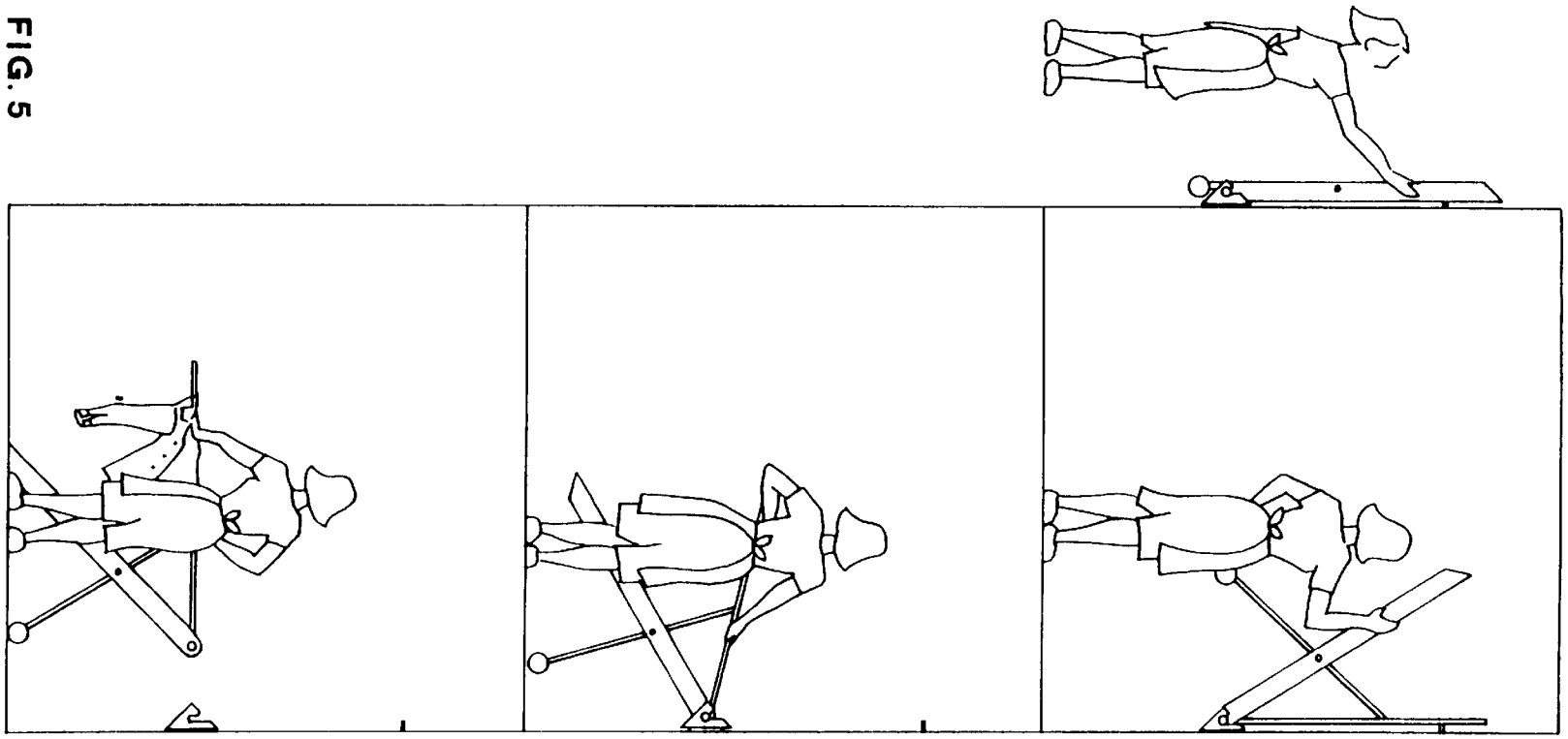
FIG. 5 illustrates the steps for opening the ironing board.
Figure 6:
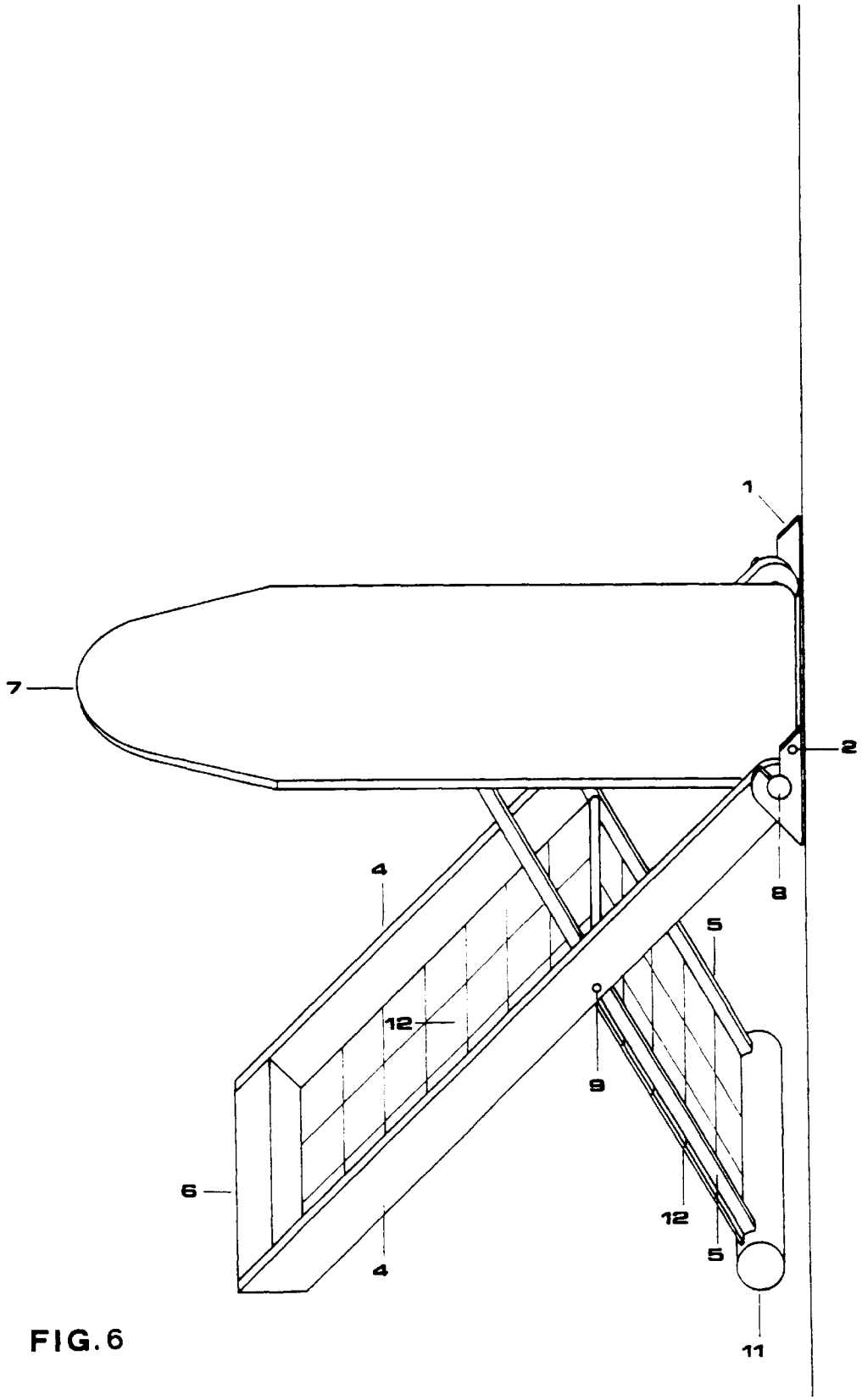
FIG. 6 illustrates an axonometric view of the ironing board in the working position.

1—wall bracket
2—locking pin
3—security hook
4—a first pair of legs
5—a second pair of legs
6—a first cross-piece
7—ironing surface
8—hinge
9—shaft
10—rail
11—a second cross-piece
12—front panel

BEST MODE FOR CARRYING OUT THE INVENTION

The best mode of carrying out this invention is to make and connect the various parts of the space saver ironing board (the ironing board surface and the two pairs of legs with attached front panels) as previously described.

What is claimed is:

1. A space saver mountable ironing board, which is closeable against a wall, characterized in that it closes up into its own structure, comprising:

a wall bracket (1) having side wings with openings;

an ironing surface (7) having a first end and a second end, being pivotally connected at the first end to a hinge (8), said hinge being hooked into the openings of the side wings of the wall bracket (1);

a first pair of legs (4) having the upper ends pivotally connected to the first end of the ironing surface (7) by the hinge (8) and the lower ends connected to a first cross-piece (6);

second pair of legs (5) having the upper ends sliding along two rails (10) on the bottom of the ironing surface (7) and the lower ends connected to a second cross-piece (11), said second pair of legs (5) being pivotally connected in the middle to the first pair of legs (4) by a shaft (9);

two front panels (12) fixed to the underside of the two pairs of legs (4 and 5).

2. The space saver mountable ironing board of claim 1 wherein, when the first pair of legs (4) is rotated upwards around the hinge (8), the ironing surface (7) also rotates upwards around the hinge (8) and the second pair of legs (5) slides at its upper ends along the rails (10), so that the front panels (12), the cross-pieces (6 and 11) and the first pair of legs (4) hide the rest of the ironing board.

3. The space saver mountable ironing board of the claim 1 or 2 characterized by the system of connection to the wall: the rotation hinge (8) being hooked into the openings of the side wings of the wall bracket (1) from which the ironing board can be unhooked and used elsewhere, the first pair of legs (4) being held in the wall bracket (1) by a locking pin (2), the ironing surface (7) being attached to the wall by a security hook (3).

4. The space saver mountable ironing board of claim 1 or 2 characterized by the possibility to mount working surfaces made of different types of shape and material.

5. The space saver mountable ironing board of claim 1 or 2 characterized by the possibililty to mount front panels (12) of different types of material.

* * * * *